US006150999A

United States Patent [19]

Chen et al.

[11] Patent Number: 6,150,999

[45] Date of Patent: Nov. 21, 2000

[54] ENERGY RECOVERY DRIVING CIRCUIT FOR DRIVING A PLASMA DISPLAY UNIT

[75] Inventors: Chern-Lin Chen, Taipei; Song-Yi Lin, Nan-Tou Hsien, both of Taiwan

[73] Assignee: Acer Display Technology, Inc., Hsinchu, Taiwan

[21] Appl. No.: 09/169,171

[22] Filed: Oct. 7, 1998

[51] Int. Cl.[7] ..... G09G 3/28

[52] U.S. Cl. ..... 345/60; 345/37; 345/69; 345/70

[58] Field of Search ..... 345/60, 37, 69, 345/70

[56] References Cited

U.S. PATENT DOCUMENTS 5,943,030 8/1999 Minamibayashi ..... 345/60

*Primary Examiner*—Kevin M. Nguyen

*Attorney, Agent, or Firm*—Winston Hsu

[57] ABSTRACT

The present invention provides a driving circuit for driving a plasma display unit. The plasma display unit can be repeatedly charged for sustaining a display of an image signal. The driving circuit comprises two driving circuits, a control circuit, and a power supply. Each of the driving circuits comprises an inductor, two switches, and two diodes. Each of the switches comprises a transistor with a parasitic diode existed between a drain and source of the transistor. The plasma display unit is electrically connected between the two inductors. The control circuit is used for controlling the on and off states of the switches so that the power supply can repeatedly charge the plasma display unit through the two driving circuits.

10 Claims, 4 Drawing Sheets

ENERGY RECOVERY DRIVING CIRCUIT FOR DRIVING A PLASMA DISPLAY UNIT

BACKGROUND OF THE INVENTION

1. Field of the Invention

The present invention relates to a driving circuit for driving a plasma display unit, and more specifically, to a low loss driving circuit for driving a plasma display while minimizing circuit complexity.

2. Description of the Prior Art

Plasma display panels are thin panels that can display over a large screen without emitting harmful radiation. Therefore, they are rapidly gaining popularity in the new large-panel market. The working principle of a plasma display panel (PDP) is to excite electric charges in the plasma by charging the PDP with a high frequency alternating voltage. In the activating process, ultraviolet rays are emitted to bombard the phosphor on the tube wall for emitting light. The plasma display panel behaves like a capacitor. When two electrodes of the PDP are suddenly short-circuited or charged by the high voltage, an inrush current will be generated which will induce electo-magnetic interference and a great loss of energy. This is a problem which the driving circuit of the plasma display panel must rectify. In order to reduce the inrush current, the driving circuit of a traditional plasma display panel uses an inductor to resonate with the intrinsic capacitor of PDP to slow down charging and discharging cycles of the plasma display panel. However, such a driving circuit is usually very complicated and costly.

Please refer to FIG. 1. FIG. 1 is a circuit diagram of a prior art single-sided driving circuit 10 for driving a plasma display unit 14. The plasma display unit 14 is represented by an equivalent load capacitor $C_L$. The single-sided driving circuit 10 comprises a two-directional switch 12, four transistors M1, M2, M5 and M6, two diodes D1 and D2, an inductor L, a high-capacity capacitor C1, and two DC power supplies V and $V_G$. The two-directional switch 12 comprises two transistors M3, M4 and two zener diodes ZD1 and ZD2 for limiting voltages.

Please refer to FIG. 2. FIG. 2 shows a timing diagram of the single-sided driving circuit 10 in FIG. 1. Diagram A shows a potential of an input node A of the two-directional switch 12. Diagram B shows a potential of an output node B of the two-directional switch 12. Diagram C shows a potential of a gate of the transistor M1. Diagram D shows a potential of a gate of the transistor M2. Diagram E shows a potential of a gate of the transistor M5. Diagram F shows a potential of a gate of the transistor M6. Vo is a potential of an output port of the plasma display unit 14. Io is a current flowing through the plasma display unit 14. Since sources of the transistors M1 and M5 are connected to high voltages, the transistor M1 or M5 will be turned on if the gate of the transistor M1 or M5 is connected to a low voltage, and turned off if the gate is connected to a high voltage. Since sources of the transistors M2 and M6 are connected to ground, the transistor M2 or M6 will be turned on if the gate of the transistor M2 or M6 is connected to a high voltage, and turned off if the gate is connected to a low voltage. The following outlines the control procedure illustrated by the timing diagrams of FIG. 2:

step 1: before T1, the output Vo of the plasma display unit 14 is at 0V, the transistors M2, M6 are in an on state, and the transistors M1, M5 are in an off state;

step 2: in T1, the gate C of the transistor M1 is reversed to a low voltage 22 thereby switching on the transistor M1 and raising the potential of node A to $V_G$ to control operations of the two-directional switch 12, the potential of the output node B will thus rise to V/2, and the inductor L and plasma display unit 14 will then resonate causing the output potential Vo rise to V slowly;

step 3: in T2, the gate D of the transistor M2 is reversed to a high voltage 24 thereby switching on the transistor M2 and dropping the input node A to 0V to control the two-directional switch 12 which causes the potential of the output node B rising to V and maintains the output potential Vo at V; because a potential difference between a drain and source of the transistor M5 is fairly close 0V, the parasitic diode existed between the drain and source thus becomes switched on, and reversing the gate E of the transistor M5 to a low voltage 26 at this time switches on the transistor M5 at a zero crossing voltage;

step 4: in T3, the gate C of the transistor M1 is again reversed to a low voltage 28 thereby switching on the transistor M1 and raising the potential of the input node A to switch on the two-directional switch 12 thus reducing the potential of the output node B to V/2, the gate E of the transistor M5 is reversed to a high voltage to switch off the transistor M5, and the inductor L and the plasma display unit 14 will resonate to slowly discharge the load capacitor $C_L$ until the output potential Vo drops to 0V;

step 5: in T4, the gate D of the transistor M2 is reversed to a high voltage thereby switching on the transistor M2 and dropping the input node A to 0V to turn off the two-directional switch 12, the output potential Vo is then maintained at 0V, and the output node B is dropped to 0V; since a potential difference between a drain and source of the transistor M6 is approaching to 0V, the parasitic diode is turned on, and reversing the gate F of the transistor M6 to a high voltage 30 at this time causes the transistor M6 to be switched on at a zero crossing voltage;

step 6: repeat step 2 to step 5 to charge and discharge the plasma display unit 14 continuously.

Because the inductor L and load capacitor $C_L$ of the single-sided driving circuit 10 form a resonance circuit, energy stored therein is mutually exchangeable. However, in order to avoid energy loss over the transistors M5, M6 and to ensure a smooth change of the output potential Vo, the transistors M5 and M6 can only be switched after resonance is achieved, that is, when the output potential Vo reaches 0 or V. At this time, the transistors M5, M6 are switched on at a zero crossing voltage since the potential difference between the drain and source of each of the transistors M5, M6 is 0.

Please refer to FIG. 3. FIG. 3 is a circuit diagram of a prior art double-sided driving circuit 40 formed by two single-sided driving circuits 10 in FIG. 1. The double-sided driving circuit 40 comprises two single-sided driving circuits 10 electrically connected to the two ends of the plasma display unit 14. The two single-sided driving circuits 10 are used for sustaining an image signal through charging and discharging the plasma display unit 14 continuously by driving plasma inside the plasma display unit 14 back and forth. Each of the single-sided driving circuits 10 comprises a two-directional switch 42 formed by the two-directional switch 12, transistors M1, M2, and DC power supply $V_G$ shown in FIG. 1, and switches Qa and Qb formed by the transistors M5 and M6. Because the double-sided driving circuit 40 uses many complicated components such as high-capacity capacitors C1, it is difficult and costly to control the driving circuit 40.

SUMMARY OF THE INVENTION

It is therefore a primary objective of the present invention to provide a driving circuit for driving a plasma display unit for solving the above mentioned problems.

In a preferred embodiment, the present invention provides a driving circuit for driving a plasma display unit over which the plasma display unit can be repeatedly charged for sustaining a display of an image signal, the driving circuit comprising a first driving circuit, a second driving circuit, a control circuit, and a power supply, the first driving circuit comprising a first inductor, a first switch electrically connected between the power supply and a first end of the first inductor, a second switch electrically connected between the first end of the first inductor and ground, a first diode electrically connected between the power supply and a second end of the first inductor, a second diode electrically connected between the second end of the first inductor and ground, wherein a first end of the plasma display unit is electrically connected with the second end of the first inductor, the second driving circuit comprises a third switch electrically connected between the power supply and a second end of the plasma display unit, a fourth switch electrically connected between the second end of the plasma display unit and ground, the control circuit is used for controlling the first, second, third and fourth switches so that the power supply can repeatedly charge the plasma display unit through the first and second driving circuits, each of the first and second switches comprises a transistor with a parasitic diode existed between a drain and source of the transistor; wherein the control circuit will:

step (1) switch on the first switch and fourth switch so that a current flowing through the first inductor will increase and a potential at the first end of the plasma display unit will increase, resulting in the first diode turning on when the potential at the first end of the plasma display unit rises to that of the power supply so that the current of the first inductor will flow through the first diode and first switch to form a first circulating current;

step (2) switch off the first switch and fourth switch and, because the current of the first inductor must follow a continuity character of current, forcing the parasitic diode of the second switch to be turned on so that the first circulating current can flow through the power supply and the parasitic diode of the second switch into the first inductor;

step (3) switch on the second switch and third switch, the second switch is turned on at a zero crossing voltage because the parasitic diode of the second switch is in an on state, the first diode will be turned off when the current of the first inductor drops to 0A, and the plasma display unit will charge the first inductor and second switch so that the current of the first inductor will increase in a reverse direction and the potential at the first end of the plasma display unit will diminish, the second diode will be turned on when the potential at the first end of the plasma display unit drops to a ground potential, and the current of the first inductor flowing in the reverse direction will flow through the second switch and second diode to form a second circulating current;

step (4) switch off the second switch and third switch and, because the current of the first inductor must follow the continuity character, the parasitic diode of the first switch will be forced to be turned on so that the second circulating current will flow through the parasitic diode of the first switch back to the power supply;

step (5) switch on the first switch and fourth switch and, because the parasitic diode of the first switch is in an on state, the first switch is turned on at a zero crossing voltage, the second diode will be switched off when the current of the first inductor flowing in the reverse direction drops to 0A, and the power supply will charge the plasma display unit through the first switch and first inductor, thus the current of the first inductor will increase and the potential at the first end of the plasma display unit will rise, the first diode will be turned on when the potential at the first end of the plasma display unit rises to that of the power supply, and the current of the first inductor will flow through the first diode and first switch to form a first circulating current;

step (6) repeat step (2) to step (5) so that the plasma display unit can be repeatedly charged for sustaining the image signal.

It is an advantage of the present invention that the driving circuit uses fewer components so that it has a much lower manufacturing cost.

These and other objectives of the present invention will no doubt become obvious to those of ordinary skill in the art after reading the following detailed description of the preferred embodiment which is illustrated in the various figures and drawings.

DETAILED DESCRIPTION OF THE PREFERRED EMBODIMENT

Figure 4:
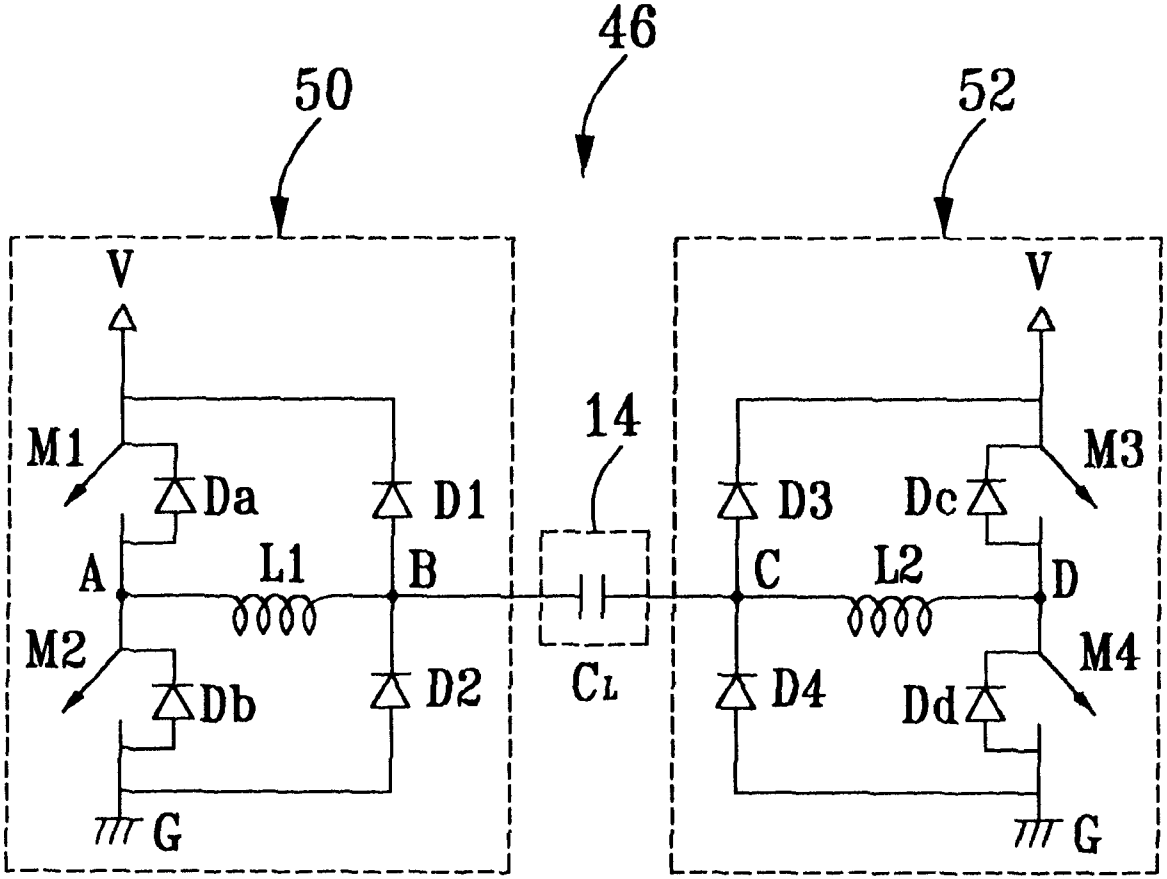
FIG. 4 is a circuit diagram of a double-sided driving circuit for driving a plasma display unit according to the present invention.

Please refer to FIG. 4. FIG. 4 is a circuit diagram of a double-sided driving circuit 46 of a plasma display unit 14 according to the present invention. The plasma display unit 14 is represented by a load capacitor $C_L$ which is repeatedly charged for sustaining a display of an image signal. The double-sided driving circuit 46 comprises two single-sided driving circuits 50 and 52, a power supply V, and a control circuit (not shown) for controlling the single-sided driving circuits 50 and 52 so that the power supply V can repeatedly charge the plasma display unit 14 through the single-sided driving circuits 50 and 52.

The single-sided driving circuit 50 comprises an inductor L1 connected between two nodes A and B, a switch M1 electrically connected between the power supply V and the node A, a switch M2 electrically connected between the node A and ground G, a diode D1 electrically connected between the power supply V and the node B, and a diode D2 electrically connected between the node B and ground G. The node B is connected to a first end of the plasma display unit 14. The single-sided driving circuit 52 comprises an inductor L2 connected between two nodes C and D, a switch M3 electrically connected between the power supply V and the node D, a switch M4 electrically connected between the node D and ground G, a diode D3 electrically connected between the power supply V and the node C, and a diode D4 electrically connected between the node C and ground G. The node C is connected to a second end of the plasma display unit 14.

The control circuit of the double-sided driving circuit 46 is used for controlling on and off of the four switches M1, M2, M3 and M4. Each of the switches M1, M2, M3 and M4 comprises a MOS (metal oxide semiconductor) transistor with a parasitic diode existed between a drain and source of the transistor. The parasitic diodes of the four transistors are represented by Da, Db, Dc and Dd in FIG. 4.

Figure 5:
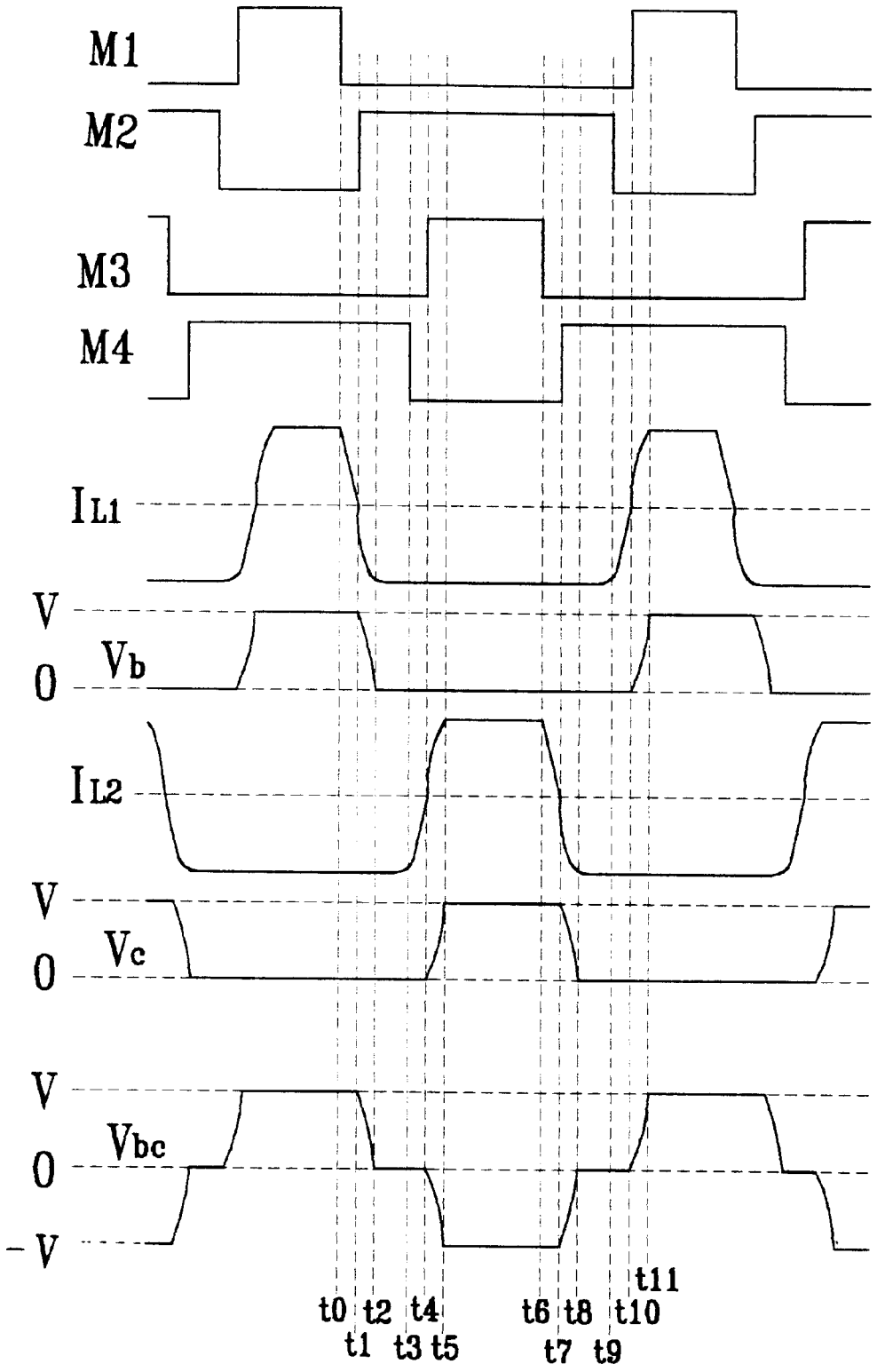
FIG. 5 is a timing diagram of the double-sided driving circuit in FIG. 4.

Please refer to FIG. 5. FIG. 5 is a timing diagram of the double-sided driving circuit 46 in FIG. 4. Diagrams M1, M2, M3 and M4 represent signals inputted to gates of the transistors M1, M2, M3 and M4 by the control circuit of the double-sided driving circuit 46. $I_{L1}$ is the current of the inductor L1. $I_{L2}$ is the current of the inductor L2. $V_b$ is the potential at the first end of the plasma display unit 14. $V_c$ is the potential at the second end of the plasma display unit 14, and $V_{bc}$ is the potential across the two ends of the plasma display unit 14. The control procedure of the double-sided driving circuit 46 is as follows:

(1) before t0, the switches M1 and M4 are in an on state, the plasma display unit 14 is charged by the power supply V through the switch M1, inductor L1, inductor L2, and switch M4; when the potential $V_b$ at the first end of the plasma display unit 14 rises to the potential of the power supply V, the diode D1 will be turned on and the current of the inductor L1 will flow through the diode D1 and switch M1 to form a first circulating current; when the potential $V_c$ at the second end of the plasma display unit 14 drops to the potential of the ground G, the diode D4 will be turned on and the current of the inductor L2 will flow through the switch M4 and diode D4 to form a fourth circulating current;

(2) at t0, the switch M1 is switched off thereby turning on the parasitic diode Db of the switch M2 because the current of the inductor L1 must follow a continuity character of current, and thus the first circulating current will flow through ground G and the switch M2 into the inductor L1; in this time, energy stored in the inductor L1 will be transmitted back to the power supply V through the parasitic diode Db and diode D1 so that the current $I_{L1}$ of the inductor L1 will dwindle;

(3) at t1, the switch M2 is switched on, because the parasitic diode Db of the switch M2 is already in an on state, the switch M2 is turned on at a zero crossing voltage; when the current $I_{L1}$ of the inductor L1 drops to 0A, the diode D1 will be cut off, the plasma display unit 14 will start to charge the inductor L1 in a reverse direction through the inductor L1 and switch M2 so that the current $I_{L1}$ of the inductor L1 will increase in the reverse direction and the potential $V_b$ at the first end of the plasma display unit 14 will diminish;

(4) at t2, when the potential $V_b$ at the first end of the plasma display unit 14 drops to the ground potential G, the diode D2 will be switched on, and the current $I_{L1}$ of the inductor L1 will flow through the switch M2 and diode D2 to form a second circulating current;

(5) at t3, the switch M4 is switched off, the parasitic diode Dc of the switch M3 is forced to be turned on because the current of the inductor L2 must follow the continuity character, and the fourth circulating current will flow through the switch M3 into the power source V; in this time, energy stored in the inductor L2 will be transmitted back to the power supply V through the parasitic diode Dc and diode D4 so that the current $I_{L2}$ of the inductor L2 will diminish;

(6) at t4, the switch M3 is switched on, the switch M3 is turned on at a zero crossing voltage because the parasitic diode Dc of the switch M3 is already in an on state; when the current $I_{L2}$ of the inductor L2 drops to 0A, the diode D4 will be cut off, the power source V will then charge the plasma display unit 14 in a reverse direction through the switch M3 and inductor L2 so that the current $I_{L2}$ of the inductor L2 will increase and the potential Vc at the second end of the plasma display unit 14 will increase;

(7) at t5, when the potential Vc at the second end of the plasma display unit 14 rises to the potential of the power supply V, the diode D3 will be turned on, and the current $I_{L2}$ of the inductor L2 will flow through the diode D3 and switch M3 to form a third circulating current;

(8) at t6, the switch M3 is switched off, the parasitic diode Dd of the switch M4 is forced to be turned on because the current of the inductor L2 must follow the continuity character, and the third circulating current will flow through ground G and the switch M4 into the inductor L2; in this time, the energy stored in the inductor L2 will be transmitted back to the power supply V through the parasitic diode Dd and diode D3 so that the current $I_{L2}$ of the inductor L2 will diminish;

(9) at t7, the switch M4 is switched on, the switch M4 is turned on at a zero crossing voltage because the parasitic diode Dd of the switch M4 is already in an on state; when the current $I_{L2}$ of the inductor L2 drops to 0A, the diode D3 will be cut off, the plasma display unit 14 will then charge the inductor L2 in the reverse direction through the inductor L2 and switch M4 so that the current $I_{L2}$ of the inductor L2 will increase in the reverse direction and the potential Vc at the second end of the plasma display unit 14 will diminish;

(10) at t8, when the potential Vc at the second end of the plasma display unit 14 drops to the ground potential G, the diode D4 will be turned on, and the current $I_{L2}$ of the inductor L2 will flow through the switch M4 and diode D4 to form a fourth circulating current;

(11) at t9, the switch M2 is switched off, the parasitic diode Da of the switch M1 is forced to be turned on because the current of the inductor L1 must follow the continuity character, and the second circulating current will flow through the power supply V and the switch M1 into the inductor L1; in this time, the energy stored in the inductor L1 will be transmitted back to the power supply V through the parasitic diode Da and diode D2 so that the current $I_{L1}$ of the inductor L1 will dwindle;

(12) at t10, the switch M1 is switched on, the switch M1 is turned on at a zero crossing voltage because the parasitic diode Da of the switch M1 is already in an on state; when the current $I_{L1}$ of the inductor L1 drops to 0A, the diode D2 will be cut off, the power source V will then charge the plasma display unit 14 through the switch M1 and inductor L1 so that the current $I_{L1}$ of the inductor L1 will increase and the potential Vb at the first end of the plasma display unit 14 will rise;

(13) at t11, when the potential Vb at the first end of the plasma display unit 14 rises to the potential of the power supply V, the diode D1 will be turned on, and the current $I_{L1}$ of the inductor L1 will flow through the diode D1 and switch M1 to form a first circulating current;

(14) repeat step (2) to step (13) to sustain the display of the image signal by charging the plasma display unit 14 repeatedly.

Some of the above mentioned steps for turning on and off the switches M1, M2, M3 and M4 can be swapped. For example, the steps (2) to (4) can be swapped with the steps (5) to (7), and the steps (8) to (10) can be swapped with the steps (11) to (13). The swaps will neither affect the charge of the plasma display unit 14 nor its energy consumption as long as the switches are switched on at a zero crossing voltage.

Figure 1:
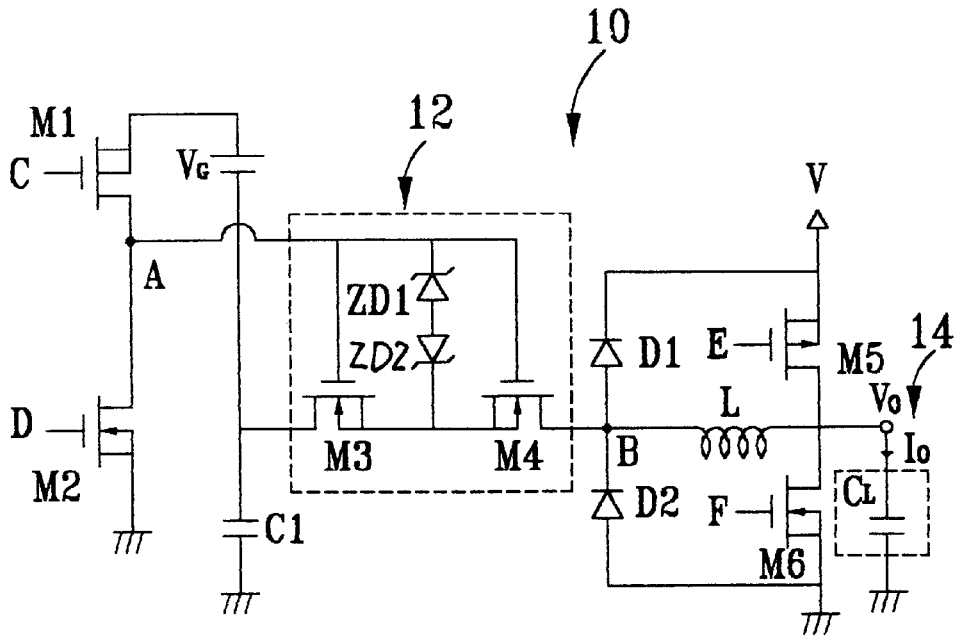
FIG. 1 PRIOR ART
FIG. 1 is a circuit diagram of a prior art single-sided driving circuit for driving a plasma display unit.
Figure 3:
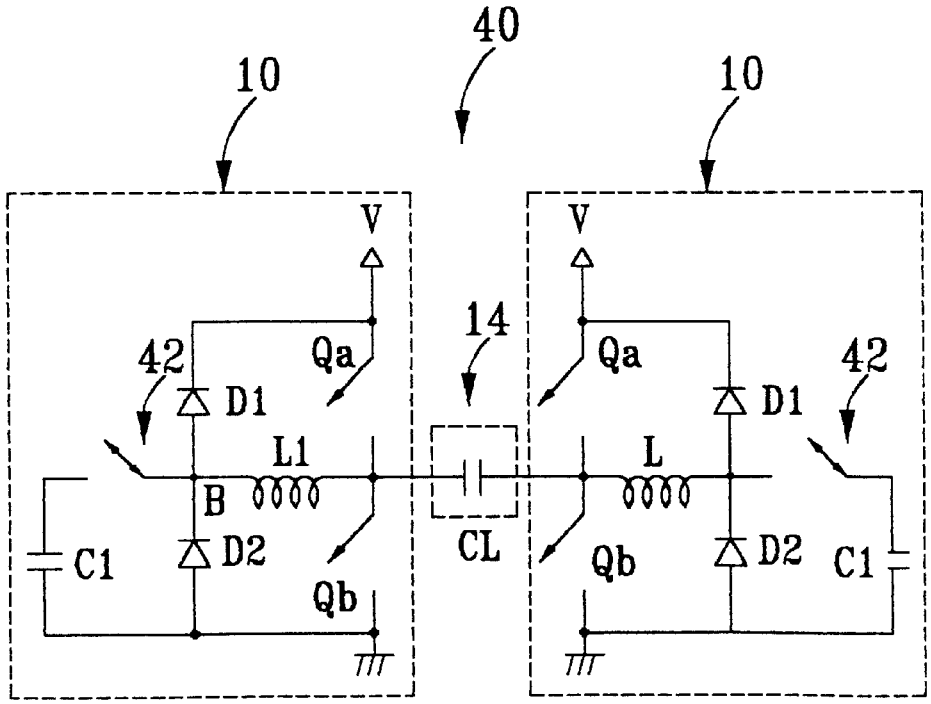
FIG. 3 PRIOR ART
FIG. 3 is a circuit diagram of a prior art double-sided driving circuit formed by two single-sided driving circuits shown in FIG. 1.
Figure 2:
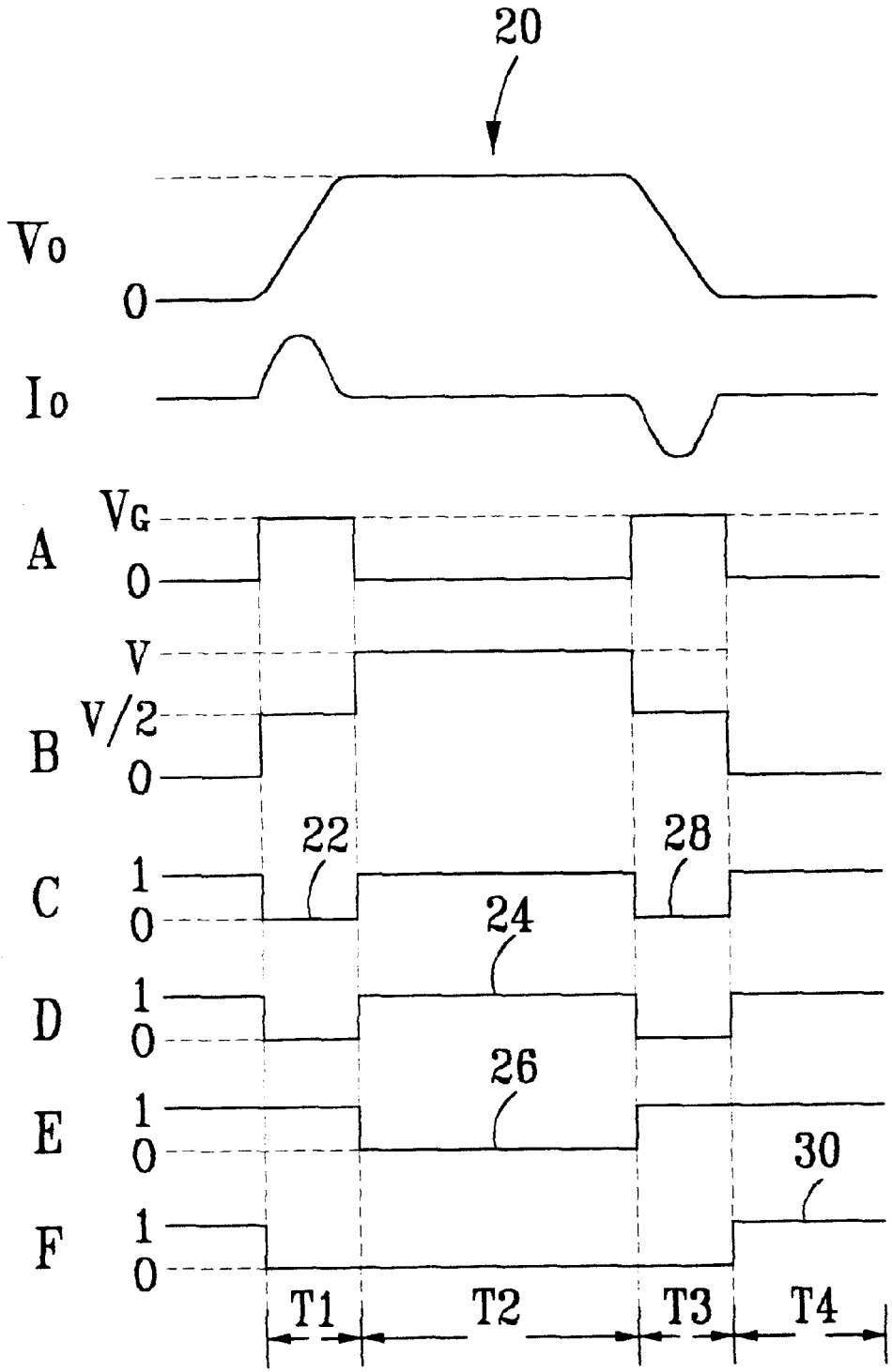
FIG. 2 PRIOR ART
FIG. 2 shows a timing diagram of the single-sided driving circuit in FIG. 1.

Comparing the double-sided driving circuit 46 according to the present invention in FIG. 4 with the prior art driving circuit 40 in FIG. 3, the double-sided driving circuit 46 has a much simpler circuit design and uses far fewer components, such as two high-capacity capacitors and two switches, than the prior art driving circuit 40. Therefore, the driving circuit 46 has a much lower manufacturing cost.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A driving circuit for driving a plasma display unit over which the plasma display unit can be repeatedly charged for sustaining a display of an image signal, the plasma display unit comprising a first end and a second end, the driving circuit comprising a first driving circuit, a second driving circuit, a control circuit, and a power supply, the first driving circuit comprising a first inductor, a first switch electrically connected between the power supply and a first end of the first inductor, a second switch electrically connected between the first end of the first inductor and a ground, a first diode electrically connected between the power supply and a second end of the first inductor, a second diode electrically connected between the second end of the first inductor and the ground, wherein the first end of the plasma display unit is electrically connected with the second end of the first inductor, the second driving circuit comprising a third switch electrically connected between the power supply and the second end of the plasma display unit, a fourth switch electrically connected between the second end of the plasma display unit and the ground, the control circuit being used for controlling the first, second, third and fourth switches so that the power supply can repeatedly charge the plasma display unit through the first and second driving circuits, each of the first and second switches comprising a transistor with a parasitic diode existed between a drain and source of the transistor; wherein the control circuit will:

step (1) switch on the first switch and fourth switch to increase the current flowing through the first inductor and the potential at the first end of the plasma display unit, and when the potential at the first end of the plasma display unit rises to the potential of the power supply, the first diode will be turned on and then the current of the first inductor will flow through the first diode and first switch to form a first circulating current;

step (2) switch off the first switch and fourth switch, the parasitic diode of the second switch will be forced to be turned on because the current of the first inductor must follow a continuity character of current, and then the first circulating current will flow through the power supply and the parasitic diode of the second switch into the first inductor;

step (3) switch on the second switch and third switch, the second switch is turned on at a zero crossing voltage because the parasitic diode of the second switch is in an on state, the first diode will be turned off when the current of the first inductor drops to 0A, the plasma display unit will start charging the first inductor through the first inductor and second switch to increase the current of the first inductor in a reverse direction, the potential at the first end of the plasma display unit will drop, the second diode will be turned on when the potential at the first end of the plasma display unit drops to a ground potential, and the current of the first inductor flowing in the reverse direction will flow through the second switch and second diode to form a second circulating current;

step (4) switch off the second switch and third switch, the parasitic diode of the first switch will be forced to be turned on because the current of the first inductor must follow the continuity character, and then the second circulating current will flow through the parasitic diode of the first switch back to the power supply;

step (5) switch on the first switch and fourth switch, the first switch is turned on at a zero crossing voltage because the parasitic diode of the first switch is in an on state, the second diode will be switched off when the current of the first inductor flowing in the reverse direction drops to 0A, the power supply will then charge the plasma display unit through the first switch and first inductor, the current of the first inductor will increase and the potential at the first end of the plasma display unit will rise, the first diode will be turned on when the potential at the first end of the plasma display unit rises to the potential of the power supply, and the current of the first inductor will flow through the first diode and first switch to form a first circulating current;

step (6) repeat steps (2) to (5) so that the plasma display unit can be repeatedly charged for sustaining the display of the image signal.

2. The driving circuit of claim 1 wherein the second driving circuit comprises a second inductor, a third diode electrically connected between the power supply and the first end of the second inductor, a fourth diode electrically connected between the first end of the second inductor and the ground, the second end of the plasma display unit is electrically connected with the first end of the second inductor, the third switch is electrically connected between the power supply and the second end of the second inductor, and the fourth switch is electrically connected between the second end of the second inductor and the ground.

3. The driving circuit of claim 2 wherein each of the third and fourth switches comprises a transistor with a parasitic diode existed between a drain and source of the transistor.

4. The driving circuit of claim 3 wherein when the control circuit executes the above mentioned steps (1) to (5), the second driving circuit will execute the following steps:

step (1) switching on the fourth switch to increase the current flowing through the second inductor in a reverse direction and drop the potential at the second end of the plasma display unit wherein when the potential at the second end of the plasma display unit drops to the ground potential, the fourth diode will be turned on and the current of the second inductor flowing in the reverse direction will flow through the fourth switch and fourth diode to form a fourth circulating current;

step (2) switching off the fourth switch to turn on the parasitic diode of the third switch because the current of the second inductor must follow the continuity character and then the fourth circulating current will flow through the parasitic diode of the third switch into the power supply;

step (3) switching on the third switch to turn on the third switch at a zero crossing voltage because the parasitic diode of the third switch is in an on state, switching off the fourth diode when the current of the second inductor flowing in the reverse direction drops to 0A, charging the plasma display unit by using the power supply through the third switch and second inductor to increase the current flowing through the second inductor and the potential at the second end of the plasma display unit, wherein when the potential at the second end of the plasma display unit rises to the potential of the power supply, the third diode will be turned on, and the current of the second inductor will flow through the third diode and third switch to form a third circulating current;

step (4) switching off the third switch to turn on the parasitic diode of the fourth switch because the current of the second inductor must follow the continuity character so that the third circulating current will flow through ground and the parasitic diode of the fourth switch into the second inductor;

step (5) switching on the fourth switch at a zero crossing voltage because the parasitic diode of the fourth switch is in an on state, switching off the third diode when the current of the second inductor drops to 0A, and charging the second inductor through the second inductor and fourth switch by using the plasma display unit, wherein the current of the second inductor will increase in a reverse direction and the potential at the second end of the plasma display unit will drop, and when the potential at the second end of the plasma display unit drops to the ground potential, the fourth diode will be turned on and the current of the second inductor in the reverse direction will flow through the fourth switch and fourth diode to form a fourth circulating current.

5. The driving circuit of claim 1 wherein the first, second, third or fourth switch can be a MOS (metal oxide semiconductor) transistor.

6. A driving method utilizing a driving circuit for driving a plasma display unit over which the plasma display unit can be repeatedly charged for sustaining a display of an image signal, the plasma display unit comprising a first end and a second end, the driving circuit comprising a first driving circuit, a second driving circuit, and a power supply, the first driving circuit comprising a first inductor, a first switch electrically connected between the power supply and a first end of the first inductor, a second switch electrically connected between the first end of the first inductor and a ground, a first diode electrically connected between the power supply and a second end of the first inductor, a second diode electrically connected between the second end of the first inductor and the ground, wherein the first end of the plasma display unit is electrically connected with the second end of the first inductor, the second driving circuit comprising a third switch electrically connected between the power supply and the second end of the plasma display unit, a fourth switch electrically connected between the second end of the plasma display unit and the ground, each of the first and second switches comprising a transistor with a parasitic diode existed between a drain and source of the transistor; wherein the driving method comprises:

step (1) switching on the first switch and fourth switch to increase the current flowing through the first inductor and the potential at the first end of the plasma display unit, wherein the first diode will be turned on when the potential at the first end of the plasma display unit rises to the potential of the power supply and then the current of the first inductor will flow through the first diode and first switch to form a first circulating current;

step (2) switching off the first switch and fourth switch to turn on the parasitic diode of the second switch because the current of the first inductor must follow a continuity character of current, so that the first circulating current will flow into the first inductor through the power supply and the parasitic diode of the second switch;

step (3) switching on the second switch and third switch, wherein the second switch is turned on at a zero crossing voltage because the parasitic diode of the second switch is in an on state, the first diode will be turned off when the current of the first inductor drops to 0A, and the plasma display unit will then charge the first inductor through the first inductor and second switch so that the current of the first inductor will increase in a reverse direction and the potential at the first end of the plasma display unit will drop, when the potential at the first end of the plasma display unit drops to the ground potential, the second diode will be turned on, and the current of the first inductor flowing in the reverse direction will flow through the second switch and second diode to form a second circulating current;

step (4) switching off the second switch and third switch, wherein the parasitic diode of the first switch will be forced to be turned on because the current of the first inductor must follow the continuity character so that the second circulating current will flow back to the power supply through the parasitic diode of the first switch;

step (5) switching on the first switch and fourth switch, wherein the first switch is turned on at a zero crossing voltage because the parasitic diode of the first switch is in an on state, the second diode will be switched off when the current of the first inductor flowing in the reverse direction drops to 0A, and the power supply will then charge the plasma display unit through the first switch and first inductor, the current of the first inductor will increase and the potential at the first end of the plasma display unit will rise, when the potential at the first end of the plasma display unit rises to the potential of the power supply, the first diode will be turned on, and the current of the first inductor will flow through the first diode and first switch to form a first circulating current;

step (6) repeating steps (2) to (5) so that the plasma display unit can be repeatedly charged for sustaining the display of the image signal.

7. The driving method of claim 6 wherein the second driving circuit comprises a second inductor, a third diode electrically connected between the power supply and the first end of the second inductor, a fourth diode electrically connected between the first end of the second inductor and the ground, the second end of the plasma display unit is electrically connected with the first end of the second inductor, the third switch is electrically connected between the power supply and the second end of the second inductor, and the fourth switch is electrically connected between the second end of the second inductor and the ground.

8. The driving method of claim 7 wherein each of the third and fourth switches comprises a transistor with a parasitic diode existed between a drain and source of the transistor.

9. The driving method of claim 8 wherein when the control circuit executes the above mentioned steps (1) to (5), the second driving circuit will execute the following steps:

step (1) switching on the fourth switch to increase the current flowing through the second inductor in a reverse direction and drop the potential at the second end of the plasma display unit, turning on of the fourth diode when the potential at the second end of the plasma display unit drops to the ground potential so that the current of the second inductor flowing in the reverse direction will flow through the fourth switch and fourth diode to form a fourth circulating current;

step (2) switching off the fourth switch to turn on the parasitic diode of the third switch because the current of the second inductor must follow the continuity character so that the fourth circulating current will flow through the parasitic diode of the third switch into the power supply;

step (3) switching on the third switch to turn on the third switch at a zero crossing voltage because the parasitic diode of the third switch is in an on state, wherein when the current of the second inductor flowing in the reverse direction drops to 0A, the fourth diode will be switched off, and the power supply will charge the plasma display unit through the third switch and second inductor, the current of the second inductor will increase and the potential at the second end of the plasma display unit will rise, when the potential at the second end of the plasma display unit rises to the potential of the power supply, the third diode will be turned on, and the current of the second inductor will flow through the third diode and third switch to form a third circulating current;

step (4) switching off of the third switch to turn on the parasitic diode of the fourth switch because the current of the second inductor must follow the continuity character and the third circulating current will flow through the ground and the parasitic diode of the fourth switch into the second inductor;

step (5) switching on the fourth switch to turn on the fourth switch at a zero crossing voltage because the parasitic diode of the fourth switch is in an on state, wherein when the current of the second inductor drops to 0A, the third diode will be switched off, the plasma display unit will charge the second inductor through the second inductor and fourth switch, the current of the second inductor will increase in a reverse direction and the potential at the second end of the plasma display unit will drop, when the potential at the second end of the plasma display unit drops to the ground potential, the fourth diode will be turned on, and the current of the second inductor in the reverse direction will flow through the fourth switch and fourth diode to form a fourth circulating current.

10. The driving method of claim 6 wherein the first, second, third or fourth switch can be a MOS transistor.

* * * * *